US011536131B2

(12) United States Patent
Holly et al.

(10) Patent No.: US 11,536,131 B2
(45) Date of Patent: Dec. 27, 2022

(54) AUTOMATED ISOLATION SYSTEM

(71) Applicant: HALLIBURTON ENERGY SERVICES, INC., Houston, TX (US)

(72) Inventors: Mark S. Holly, Spring, TX (US); Kurt Rohrbough Harpold, Jr., Kingwood, TX (US); James Marshall Barker, Mansfield, TX (US); Ronald Glen Dusterhoft, Katy, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/884,269

(22) Filed: May 27, 2020

(65) Prior Publication Data

US 2021/0372271 A1 Dec. 2, 2021

(51) Int. Cl.

| | |
|---|---|
| ***E21B 47/09*** | (2012.01) |
| ***E21B 47/12*** | (2012.01) |
| ***E21B 33/12*** | (2006.01) |
| ***E21B 43/11*** | (2006.01) |
| *E21B 43/14* | (2006.01) |
| *E21B 43/26* | (2006.01) |

(52) U.S. Cl.

CPC ..... *E21B 47/09* (2013.01); *E21B 33/12* (2013.01); *E21B 43/11* (2013.01); *E21B 47/12* (2013.01); *E21B 43/14* (2013.01); *E21B 43/26* (2013.01)

(58) Field of Classification Search

CPC ..... E21B 33/12; E21B 43/11; E21B 47/09; E21B 47/12

See application file for complete search history.

(56) References Cited

U.S. PATENT DOCUMENTS

| | | | | |
|---|---|---|---|---|
| 6,962,202 | B2 | 11/2005 | Bell et al. | |
| 7,284,489 | B2 | 10/2007 | Bell et al. | |
| 7,284,601 | B2 | 10/2007 | Bell et al. | |
| 7,350,448 | B2 | 4/2008 | Bell et al. | |
| 7,461,580 | B2 | 12/2008 | Bell et al. | |
| 7,975,592 | B2 | 7/2011 | Bell et al. | |
| 2013/0206402 | A1 * | 8/2013 | Coon | E21B 43/14 166/255.1 |
| 2015/0292319 | A1 | 10/2015 | Disko et al. | |
| 2015/0361761 | A1 | 12/2015 | Lafferty et al. | |

(Continued)

OTHER PUBLICATIONS

International Search Report, Response & Written Opinion, PCT Application No. PCT/US2020/037844, dated Oct. 15, 2020.

*Primary Examiner* — Robert E Fuller
*Assistant Examiner* — Lamia Quaim
(74) *Attorney, Agent, or Firm* — Novak Druce Carroll LLP

(57) ABSTRACT

Techniques for plugging at least one zone of a hydrocarbon well are disclosed herein. The techniques include methods for deploying a wellbore dart configured for plugging the at least one zone of the hydrocarbon well, receiving, by a first node, location information indicating a first location of the wellbore dart, receiving, by a second node, location information indicating a second location of the wellbore dart, and detecting, an arrival of the wellbore dart at an intended location for the dart to plug the zone of the hydrocarbon well. In some aspects, the method further includes sending a command to a firing module of the wellbore dart, the command effective to cause the wellbore dart to plug the zone of the hydrocarbon well. Systems and computer-readable media are also provided.

20 Claims, 7 Drawing Sheets

(56) References Cited

U.S. PATENT DOCUMENTS

| | | | | |
|---|---|---|---|---|
| 2016/0076363 | A1* | 3/2016 | Morrow | E21B 43/11 166/255.1 |
| 2016/0084075 | A1* | 3/2016 | Ingraham | E21B 23/01 166/255.1 |
| 2016/0215612 | A1 | 7/2016 | Morrow | |
| 2016/0258260 | A1* | 9/2016 | Walton | E21B 47/092 |
| 2017/0032653 | A1 | 2/2017 | Crawford et al. | |

* cited by examiner

600

AUTOMATED ISOLATION SYSTEM

TECHNICAL FIELD

The present technology pertains to plugging a zone of a hydrocarbon well, and more particularly to communicating through nodes in a casing surrounding the hydrocarbon well to perforate the casing, plug the zone of the hydrocarbon well, and monitor a status of the hydrocarbon well.

BACKGROUND

Completion of a wellbore through hydraulic fracturing is a complex process. The hydraulic fracturing process includes a number of different variables that can be altered to perform a well completion. Conventional methods and systems for monitoring, isolating, perforating and/or controlling the fracturing process include time consuming, expensive, and dangerous processes of deploying, installing, removing, re-deploying, re-installing, and re-removing of various conventional systems.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
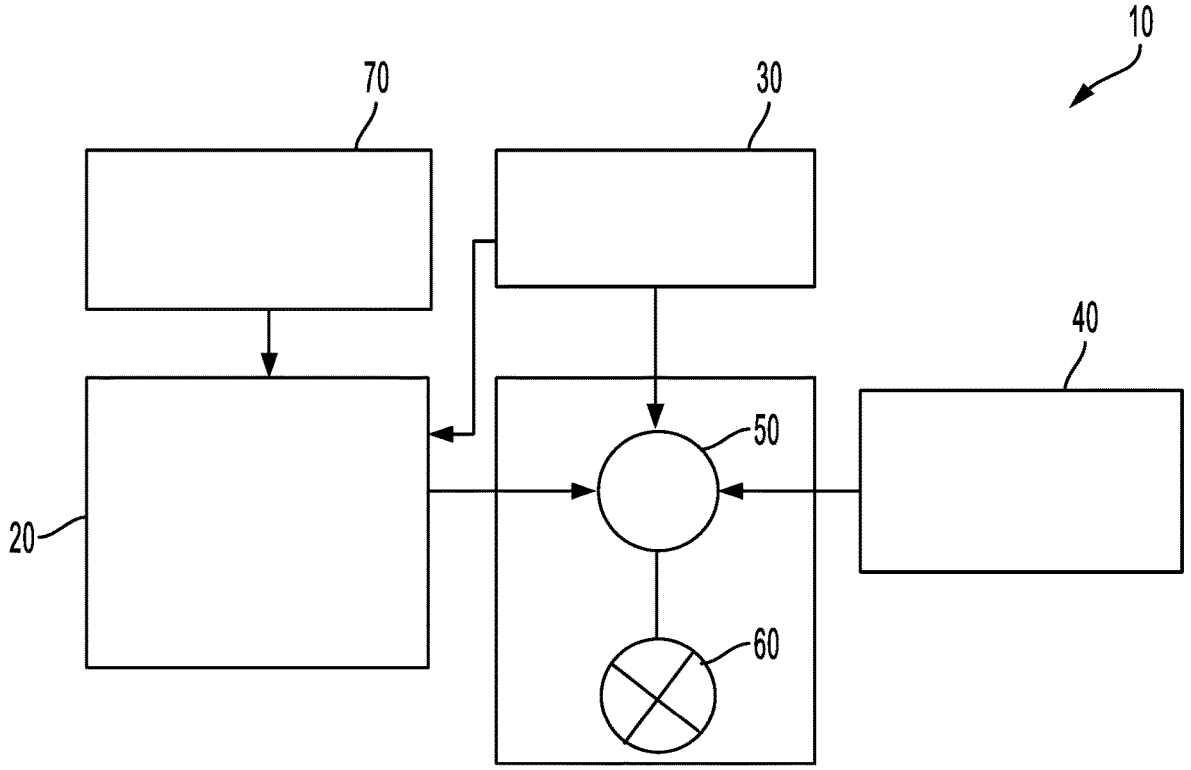
FIG. 1 is a schematic diagram of an example fracturing system, in accordance with various aspects of the subject technology.

Various embodiments of the disclosure are discussed in detail below. While specific implementations are discussed, it should be understood that this is done for illustration purposes only. A person skilled in the relevant art will recognize that other components and configurations can be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts can be exaggerated to better illustrate details and features. The description is not to be considered as limiting the scope of the embodiments described herein.

Well perforations and fracturing are done in a sequence and have separate operations prior to completion of a well. More specifically, wireline operations are first conducted to log subsurface data and set plugs to isolate zones of the well. The crews operating the wireline operations then perforate portions of the well using explosives on the wireline. Next, the wireline crews must bring up the wireline tools and rig off the well head, so that the fracturing crews may then rig up to the wellhead and pump down the fracturing fluid to fracture the perforated portions of the well. The transition between bringing up the wireline tools and pumping down the fracturing fluid is costly, inefficient, and dangerous. More specifically, large crane lifts are typically used to install long lubricator assemblies between each perforation and fracturing stage. This results in long delays between rigging wireline up and installing the lubricator and tool assemblies and potential dangers by repeatedly using these large crane lifts. Moreover, installation of the lubricator assemblies require high pressure equipment, which may further result in potentially dangerous scenarios. Furthermore, each well typically has multiple zones, which further compounds the long delays and potential dangers.

Thus, disclosed are systems and methods for efficiently plugging a zone of a hydrocarbon well, perforating a casing of the hydrocarbon well at the zone, and pumping down fracturing fluids.

Turning now to FIG. 1, an example fracturing system 10 is shown. The fracturing system 10 includes a fracturing fluid producing apparatus 20, a fluid source 30, a solid source 40, and a pump and blender system 50. All or an applicable combination of these components of the fracturing system 10 can reside at the surface at a well site/fracturing pad where a well 60 is located.

During a fracturing job, the fracturing fluid producing apparatus 20 can access the fluid source 30 for introducing/controlling flow of a fluid, e.g. a fracturing fluid, in the fracturing system 10. While only a single fluid source 30 is shown, the fluid source 30 can include a plurality of separate fluid sources. Further, the fracturing fluid producing apparatus 20 can be omitted from the fracturing system 10. In turn, the fracturing fluid can be sourced directly from the fluid source 30 during a fracturing job instead of through the intermediary fracturing fluid producing apparatus 20.

The fracturing fluid can be an applicable fluid for forming fractures during a fracture stimulation treatment of the well 60. For example, the fracturing fluid can include water, a hydrocarbon fluid, a polymer gel, foam, air, wet gases, and/or other applicable fluids. In various embodiments, the fracturing fluid can include a concentrate to which additional fluid is added prior to use in a fracture stimulation of the well 60. In certain embodiments, the fracturing fluid can include a gel pre-cursor with fluid, e.g. liquid or substantially liquid, from fluid source 30. Accordingly, the gel pre-cursor with fluid can be mixed by the fracturing fluid producing apparatus 20 to produce a viscous fracturing fluid for forming fractures.

The solid source 40 can include a volume of one or more solids for mixture with a fluid, e.g. the fracturing fluid, to form a solid-laden fluid. The solid-laden fluid can be pumped into the well 60 as part of a solids-laden fluid stream that is used to form and stabilize fractures in the well 60 during a fracturing job. The one or more solids within the solid source 40 can include applicable solids that can be added to the fracturing fluid of the fluid source 30. Specifically, the solid source 40 can contain one or more proppants for stabilizing fractures after they are formed during a fracturing job, e.g. after the fracturing fluid flows out of the formed fractures. For example, the solid source 40 can contain sand.

The fracturing system 10 can also include additive source 70. The additive source 70 can contain/provide one or more applicable additives that can be mixed into fluid, e.g. the fracturing fluid, during a fracturing job. For example, the additive source 70 can include solid-suspension-assistance agents, gelling agents, weighting agents, and/or other optional additives to alter the properties of the fracturing fluid. The additives can be included in the fracturing fluid to reduce pumping friction, to reduce or eliminate the fluid's reaction to the geological formation in which the well is formed, to operate as surfactants, and/or to serve other applicable functions during a fracturing job. The additives can function to maintain solid particle suspension in a mixture of solid particles and fracturing fluid as the mixture is pumped down the well 60 to one or more perforations.

The pump and blender system 50 functions to pump fracture fluid into the well 60. Specifically, the pump and blender system 50 can pump fracture fluid from the fluid source 30, e.g. fracture fluid that is received through the fracturing fluid producing apparatus 20, into the well 60 for forming and potentially stabilizing fractures as part of a fracture job. The pump and blender system 50 can include one or more pumps. Specifically, the pump and blender system 50 can include a plurality of pumps that operate together, e.g. concurrently, to form fractures in a subterranean formation as part of a fracturing job. The one or more pumps included in the pump and blender system 50 can be an applicable type of fluid pump. For example, the pumps in the pump and blender system 50 can include electric pumps and/or gas powered pumps.

The pump and blender system 50 can also function to receive the fracturing fluid and combine it with other components and solids. Specifically, the pump and blender system 50 can combine the fracturing fluid with volumes of solid particles, e.g. proppant, from the solid source 40 and/or additional fluid and solids from the additive source 70. In turn, the pump and blender system 50 can pump the resulting mixture down the well 60 at a sufficient pumping rate to create or enhance one or more fractures in a subterranean zone, for example, to stimulate production of fluids from the zone. While the pump and blender system 50 is described to perform both pumping and mixing of fluids and/or solid particles, in various embodiments, the pump and blender system 50 can function to just pump a fluid stream, e.g. a fracture fluid stream, down the well 60 to create or enhance one or more fractures in a subterranean zone.

The fracturing fluid producing apparatus 20, fluid source 30, and/or solid source 40 can be equipped with one or more monitoring devices (not shown). The monitoring devices can be used to control the flow of fluids, solids, and/or other compositions to the pumping and blender system 50. Such monitoring devices can effectively allow the pumping and blender system 50 to source from one, some or all of the different sources at a given time. In turn, the pumping and blender system 50 can provide just fracturing fluid into the well at some times, just solids or solid slurries at other times, and combinations of those components at yet other times.

Figure 2:
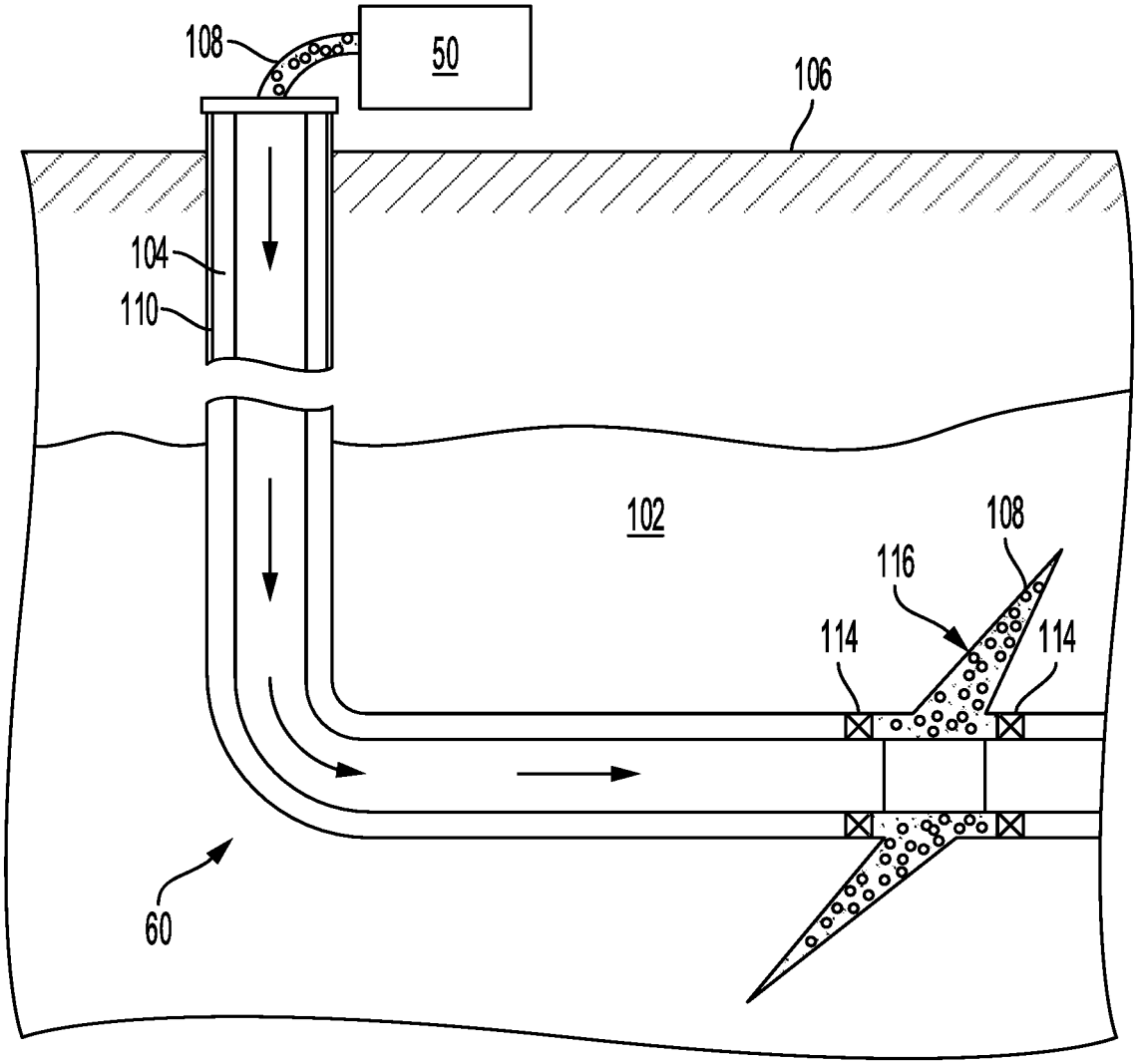
FIG. 2 shows an example well during a fracturing operation, in accordance with various aspects of the subject technology.

FIG. 2 shows the well 60 during a fracturing operation in a portion of a subterranean formation of interest 102 surrounding a wellbore 104. The fracturing operation can be performed using one or an applicable combination of the components in the example fracturing system 10 shown in FIG. 1. The wellbore 104 extends from the surface 106, and the fracturing fluid 108 is applied to a portion of the subterranean formation 102 surrounding the horizontal portion of the wellbore. Although shown as vertical deviating to horizontal, the wellbore 104 can include horizontal, vertical, slant, curved, and other types of wellbore geometries and orientations, and the fracturing treatment can be applied to a subterranean zone surrounding any portion of the wellbore 104. The wellbore 104 can include a casing 110 that is cemented or otherwise secured to the wellbore wall. The wellbore 104 can be uncased or otherwise include uncased sections. Perforations can be formed in the casing 110 to allow fracturing fluids and/or other materials to flow into the subterranean formation 102. Perforations can be formed in the casing 110 using an applicable wireline-free actuation. In the example fracture operation shown in FIG. 2, a perforation is created between points 114.

The pump and blender system 50 is fluidly coupled to the wellbore 104 to pump the fracturing fluid 108, and potentially other applicable solids and solutions into the wellbore 104. When the fracturing fluid 108 is introduced into wellbore 104 it can flow through at least a portion of the wellbore 104 to the perforation, defined by points 114. The fracturing fluid 108 can be pumped at a sufficient pumping rate through at least a portion of the wellbore 104 to create one or more fractures 116 through the perforation and into the subterranean formation 102. Specifically, the fracturing fluid 108 can be pumped at a sufficient pumping rate to create a sufficient hydraulic pressure at the perforation to form the one or more fractures 116. Further, solid particles, e.g. proppant from the solid source 40, can be pumped into the wellbore 104, e.g. within the fracturing fluid 108 towards the perforation. In turn, the solid particles can enter the fractures 116 where they can remain after the fracturing fluid flows out of the wellbore. These solid particles can stabilize or otherwise "prop" the fractures 116 such that fluids can flow freely through the fractures 116.

While only two perforations at opposing sides of the wellbore 104 are shown in FIG. 2, greater than two perforations can be formed in the wellbore 104, e.g. along the top side of the wellbore 104, as part of a perforation cluster. Further, multiple perforation clusters can be included in or otherwise formed during a single fracturing stage. Fractures can then be formed through the plurality of perforations in the perforation cluster as part of a fracturing stage for the perforation cluster. Specifically, fracturing fluid and solid particles can be pumped into the wellbore 104 and pass through the plurality of perforations during the fracturing stage to form and stabilize the fractures through the plurality of perforations.

Figure 3:
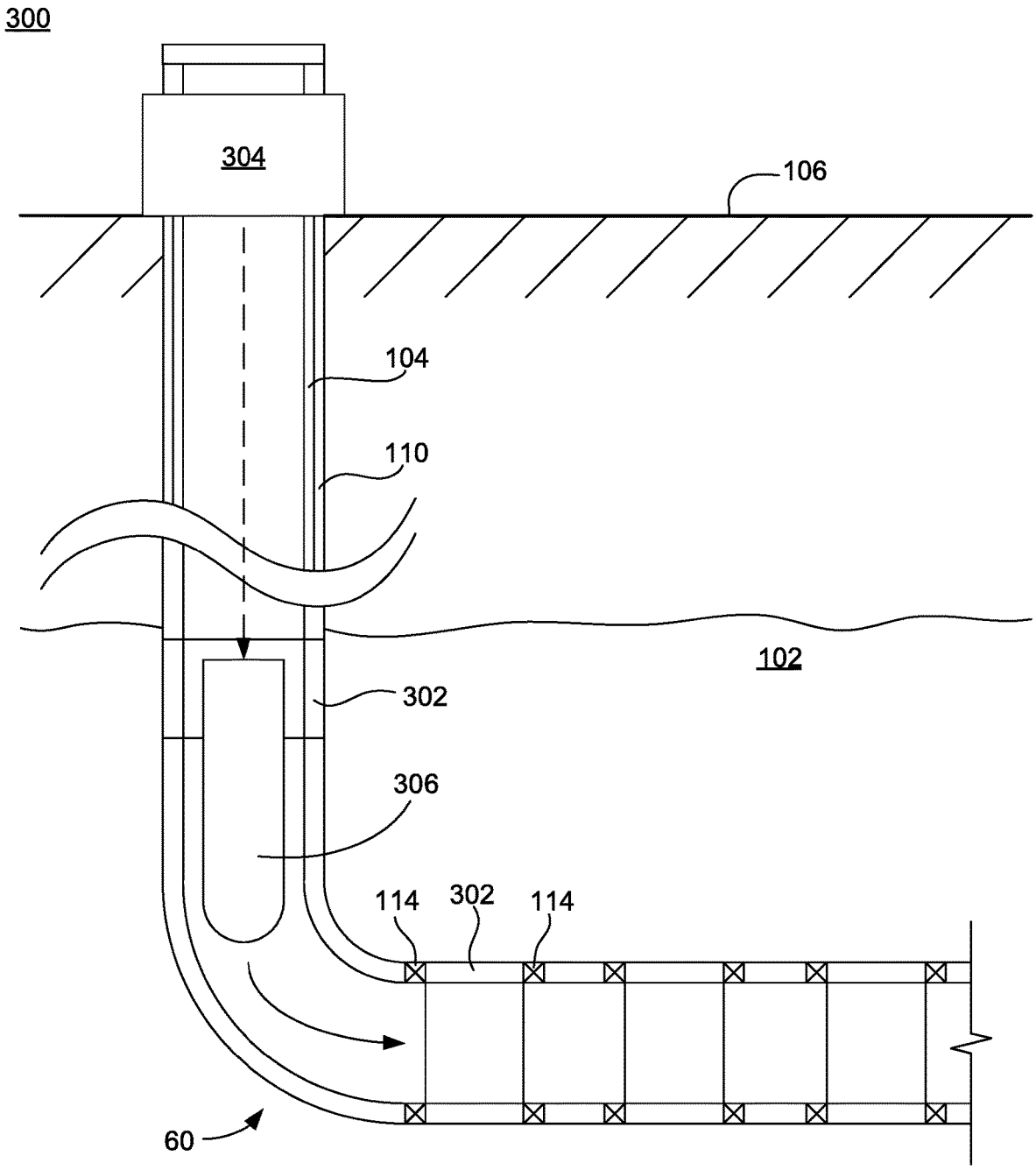
FIG. 3 shows a well having a casing with nodes embedded therein, in accordance with various aspects of the subject technology.

FIG. 3 shows an example environment 300 having the well 60 prior to perforation. The wellbore 104 extends from the surface 106 and is lined with the casing 110. Nodes 302 are embedded along and/or around the casing 110. Further down the well 60, the nodes 302 are embedded between the points 114, such that the nodes 302 are positioned to be adjacent to the fractures 116 of FIG. 2. In other words, the downhole nodes 302 are locations for subsequent perforation and fracturing. As will be discussed further in detail below, the nodes 302 are configured to communicate with one another to send and receive data both up the well and down the well. Furthermore, the nodes 302 may also communicate with a surface operator 304. The surface operator 304 can receive the uplink signals from the nodes 302. Furthermore, the surface operator 304 can send signals and commands downhole to the nodes 302 to actuate actions on the nodes and/or a wellbore dart 306.

The wellbore dart 306 is configured to travel down the wellbore 104 and may have communication modules to communicate with the nodes 302. More specifically, the wellbore dart 306 travels down the wellbore 104 and communicates with the nodes 302, which determine location information of the wellbore dart 306. The nodes 302 then communicate the location information uplink to the surface operator 304. When the wellbore dart 306 reaches an intended location, such as the deepest node, the deepest node may communicate the location of the wellbore dart 306 to the surface operator 304, to which the surface operator 304 may send a command down to nodes 302 to the deepest node. The deepest node may then communicate the command to the wellbore dart 306. The command may cause the wellbore dart to set a plug to create an isolation. Next, the deepest node may perforate the casing 110, using explosives and/or a firing module in the node. The deepest node may then send confirmation uplink through the nodes 302 to the surface operator 304 to indicate that perforation has occurred and/or to notify the fracturing crew to begin pumping down the fracturing fluids. After the fracturing fluids have been pumped down, the process may be repeated with the next deepest node or any other different node.

Figure 4:
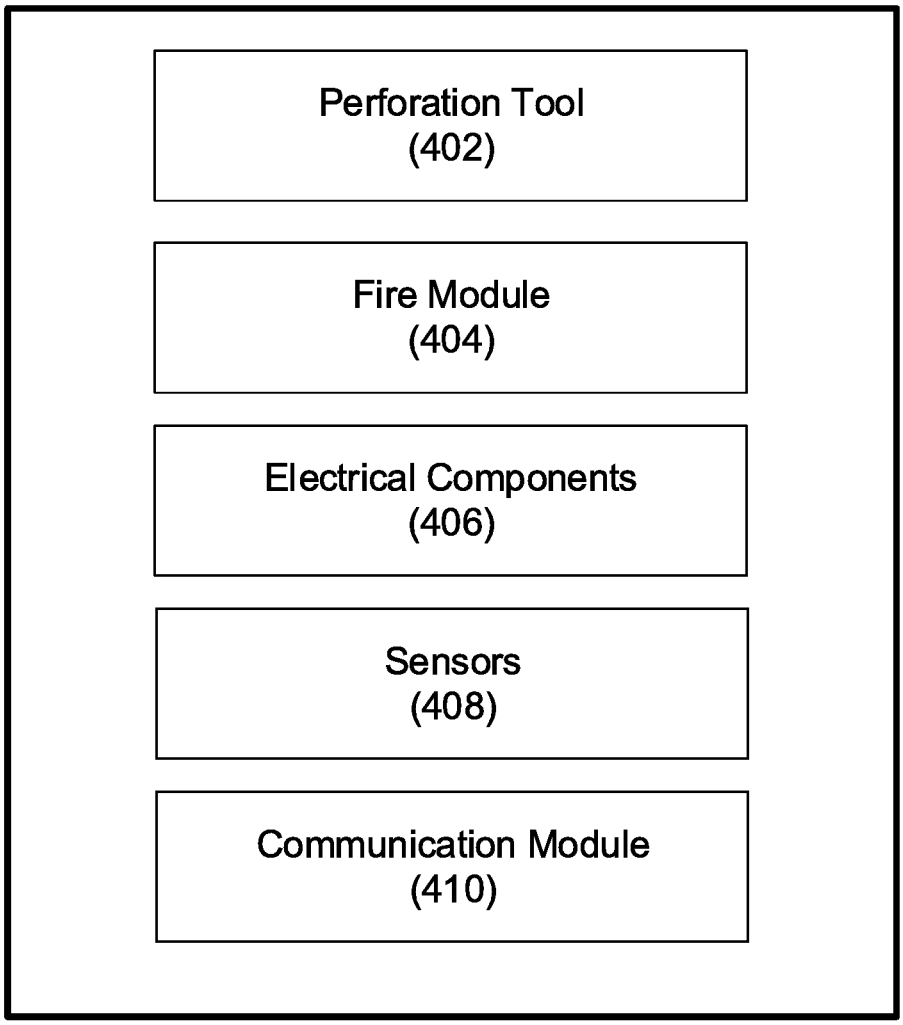
FIG. 4 shows a schematic diagram of a node, in accordance with various aspects of the subject technology.

FIG. 4 illustrates a node 400 according to an example. The node 400 can be implemented to communicate both uplink to the surface operator 304 and/or other nodes 400 and downlink to other nodes 400. In this example, the node 400 can include perforations tools 402, a firing module 404, electrical components 406, sensors 408 and a communication module 410. In some embodiments, the node 400 is cemented in place around an outside of the casing 110 prior to the casing 110 being installed in the well 60. The casing 110 would then be deployed into the well 60 and the nodes 400 would be cemented into the casing 110 around the wellbore 104.

Perforation tools 402 may be shaped charges, a perforating gun, hydro-jetting and/or other tools. The perforation tools 402 are capable of creating perforations in the casing 110 to allow fracturing fluids and/or other materials to flow into the subterranean formation 102. In some embodiments, the perforation tools 402 are directional shape charges that fire from an outer periphery of the casing 110 inwards toward the wellbore 104. Similarly, in some embodiments, the perforation tools 402 are directional shape charges that fire in the other direction through the casing and cement and into the subterranean formation 102. In some embodiments, the nodes may not need perforation tools. For example, upwell nodes near the surface 106 may not need perforation tools because it may be dangerous to perforate the casing 110 near the surface 106 and/or may be costly. Similarly, other embodiments may have the perforation tools on the wellbore dart.

Firing module 404 is a module configured to charge and fire the perforation tools 402. More specifically, the firing module 404 is configured to receive commands and responsively charge and fire the perforation tools 402. Like the perforation tools, in some embodiments, the nodes may not need the firing module 404. For example, upwell nodes near the surface 106 may not have perforation tools; thus these upwell nodes may not require a firing module.

Electrical components 406 configured to provide power to the firing module 404, the sensors 408, and the communication module 410. The electrical components 406 may include a battery and wiring to provide power to the other parts.

Sensors 408 are configured to monitor the well 60 during fracturing processes and provide data around each node 400. Furthermore, as a zone is isolated by plugs, the sensors 408 are capable of collecting isolated data on the isolated zone around the node 400. For example, sensors 408 may include a "pinger" to transmit signals at brief intervals to measure seismic activity and collect seismic data. The seismic data may then be used to determine fracturing models to optimize for well stability. Similarly, the sensors 408 may include location sensors, such as Global Positioning System sensors, to capture location data of the node 400. It is further contemplated that the sensors 408 may include an accelerometer to determine speeds of passing objects, such as a wellbore dart, or flow rates of fluids, such as fracturing fluids. It is to be understood that many other sensors 408 are within the breadth of this disclosure including, but not limited to temperature sensors, pressure sensors, etc.

Communication module 410 is configured to communicate with communication modules 410 of other nodes 400 and the surface operator 304. The communication module 410 may include hardware and software components to send and receive information to and from the other communication modules and the surface operator 304. As will be discussed further below, the communication module 410 may be configured to communicate with a communication module on a wellbore dart to determine location information of the wellbore dart.

It is further contemplated that the perforation tools 402, firing module 404, electrical components 406, sensors 408, and communication module 410 may also act as a centralizer. More specifically, the various parts 402-410 may create ribs and circle around the casing 110 of the wellbore 104. In other words, the various 402-410 may be centralized circumferentially around the wellbore 104 and preserve the center of the wellbore 104.

Figure 5:
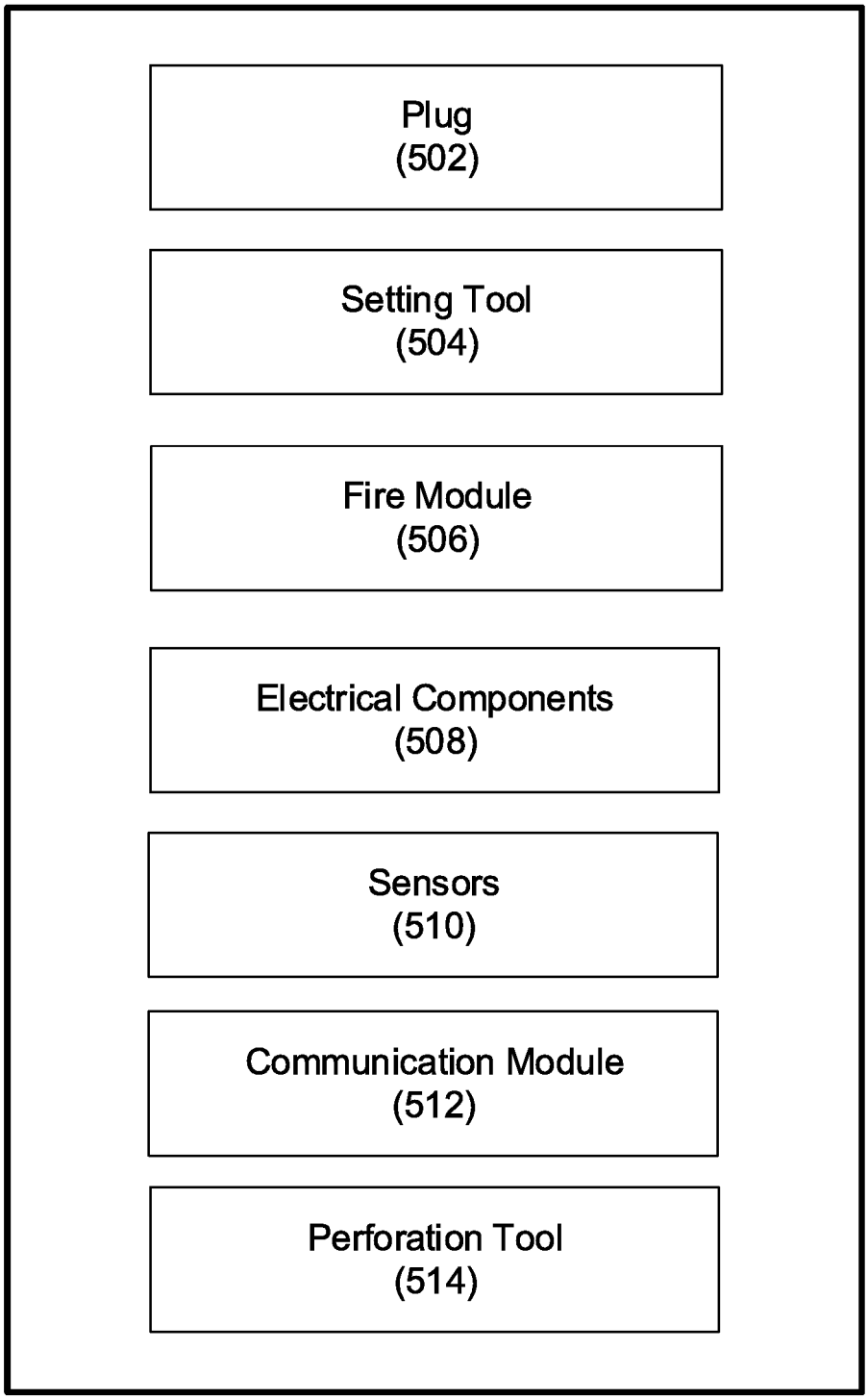
FIG. 5 shows a schematic diagram of a wellbore dart, in accordance with various aspects of the subject technology.

FIG. 5 illustrates a wellbore dart 500 according to an example. The wellbore dart 500 can be implemented to isolate a zone of the well 60 and, in some embodiments, perforate the casing 110 of the well 60. In this example, the wellbore dart 500 can include a plug 502, a setting tool 504, a firing module 506, electrical components 508, sensors 510, a communication module 512, and a perforation tool 514.

Plug 502 is configured to seal and/or isolate a zone of the well 60. The plug 502 may seal and/or isolate the zone using a variety of different methods including, but not limited to, chemical compounds, mechanical structures (e.g. a flapper valve), an Illusion® Dissolvable Frac Plug, a composite bridge plug, etc. It is contemplated that dissolvable technologies, such as the Illusion® Frac Plug may eliminate any retrieval process at a later date.

Setting tool 504 is configured to set the plug 502. More specifically, the setting tool 504 may arm and position the plug 502, so that the zone is properly isolated. It is further contemplated that in some embodiments, the setting tool may be activated by installing uniquely identified shoulders in the casing 110, such that the wellbore dart 500 may pass through the shoulders until reaching a shoulder with a matching identifier. The shoulder with the matching identifier would stop the wellbore dart 500 and set the wellbore dart in the proper position for zone isolation. In some embodiments, the shoulders may simply increase in size further downhole. Similarly, it is further contemplated that the setting tool may be removed by simply using position and speed information of the wellbore dart 500 as the wellbore dart 500 traverses the well 60, such that proper placement of the plug 502 may be determined using the position and speed information.

Firing module 506 is a module configured to charge and fire the setting tool 504 and plug 502. More specifically, the firing module 506 is configured to receive commands and responsively charge and fire setting tool 504 and plug 502.

Like electrical components 406, electrical components 508 are configured to provide power to the firing module 506, the sensors 510, and the communication module 512. The electrical components 508 may include a battery and wiring to provide power to the other parts.

Sensors 510 provide information about the wellbore dart 500 as the wellbore dart 500 traverses the well 60. Like sensors 408, sensors 510 may include location sensors, such as Global Positioning System sensors, to capture location data of the wellbore dart 500. It is further contemplated that the sensors 510 may include an accelerometer to determine a speed of the wellbore dart 500. It is to be understood that many other sensors 510 are within the breadth of this disclosure including, but not limited to temperature sensors, pressure sensors, etc.

Communication module 512 is configured to communicate with communication modules 410 of the nodes 400 and the surface operator 304. The communication module 512 may include hardware and software components to send and receive information to and from the communication modules 410 of the nodes 400 and the surface operator 304. The communication module 512 is further configured to communicate with the communication modules 410 of the nodes 400 to determine location information of the wellbore dart. For example, the communication module 512 of the wellbore dart 500 may briefly communicate with a communication module 410 of a node 400. The node 400 would be able to determine the location of the wellbore dart 500 by determining the location of the node 400 and a distance between the node 400 and the wellbore dart 500. Furthermore, the node 400 would be able to determine a speed of the wellbore dart 500 by determining a duration of communication between the communication module 410 and the communication module 512 of the wellbore dart 500 and a maximum distance for communication between the communication module 410 and the communication module 512. The speed and location information of the wellbore dart 500 may then be communicated uphole to the surface operator 304. Communication between the communication module 512 and the communication modules 410 may be through acoustic coupling, electromagnetic waves, Near-Field Communications, BlueTooth technologies, etc.

In some embodiments, the wellbore dart 500 may include a perforation tool 514. The perforation tool 514 may be shaped charges, a perforating gun, chemical cutting/perforating, hydro-jetting and/or other tools. The perforation tool 514 is capable of creating perforations in the casing 110 to allow fracturing fluids and/or other materials to flow into the subterranean formation 102. In some embodiments, the perforation tool 514 may be directional shaped charges that fire through the cement and into the subterranean formation 102.

Figure 6:
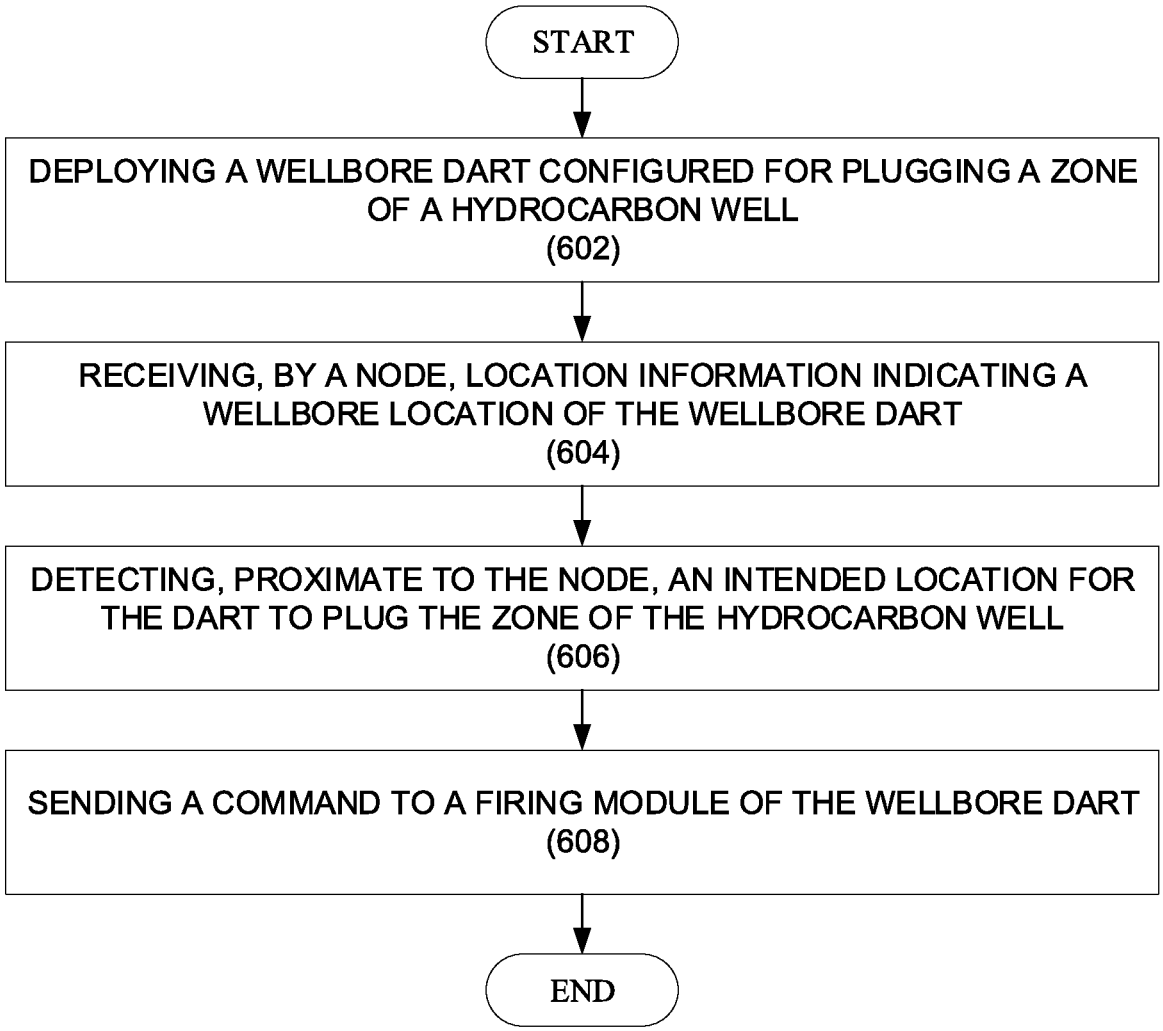
FIG. 6 is a flow chart illustrating a novel method for plugging of a well zone, in accordance with various aspects of the subject technology.

FIG. 6 illustrates an example method 600 for plugging a zone of a hydrocarbon well. For the sake of clarity, the method 600 is described in terms of a surface operator. The steps outlined herein are exemplary and can be implemented in any combination thereof, including combinations that exclude, add, or modify certain steps.

At step 602, the surface operator deploys a wellbore dart configured for plugging a zone of a hydrocarbon well.

At step 604, the surface operator receives, by a node, location information indicating a wellbore location of the wellbore dart. More specifically, the wellbore dart includes a communication module that communicates with the node as the wellbore dart traverses through the hydrocarbon well.

In some embodiments, the node is positioned adjacent to an interior surface of the hydrocarbon well.

In some embodiments, the location information further indicates a speed of the wellbore dart travelling through the hydrocarbon well.

In some embodiments, the node is in communication with the surface operator through at least one acoustic coupling, fiber optic cables, or electromagnetic waves.

In some embodiments, the node is in communication with a second node to relay data from the second node to the surface operator.

At step 606, the surface operator detects an intended location proximate to the node for the wellbore dart to plug the zone of the hydrocarbon well.

At step 608, the surface operator sends, after determining that the wellbore location of the wellbore dart is at the intended location, a command to a firing module of the wellbore dart. More specifically, the surface operator sends the command to the communication module of the wellbore dart, which communicates the command to the firing module. The command is effective to cause the wellbore dart to plug the zone of the hydrocarbon well.

The method 600 may then be repeated for each subsequent zone using a node uphole. In particular, the method 600 may be repeated without costly, inefficient, and dangerous reinstalling of high crane lifts, lubricator assemblies, and the like. In other words, the method 600 and technologies disclosed above eliminate the need to constantly switch between wireline crews and fracturing crews. For example, a device launching the dart may be attached to an entry of the well, so that the dart may be launched into a fluid stream of the well as desired. In some scenarios, ball launchers for sliding sleeve operations may be used.

Figure 7:
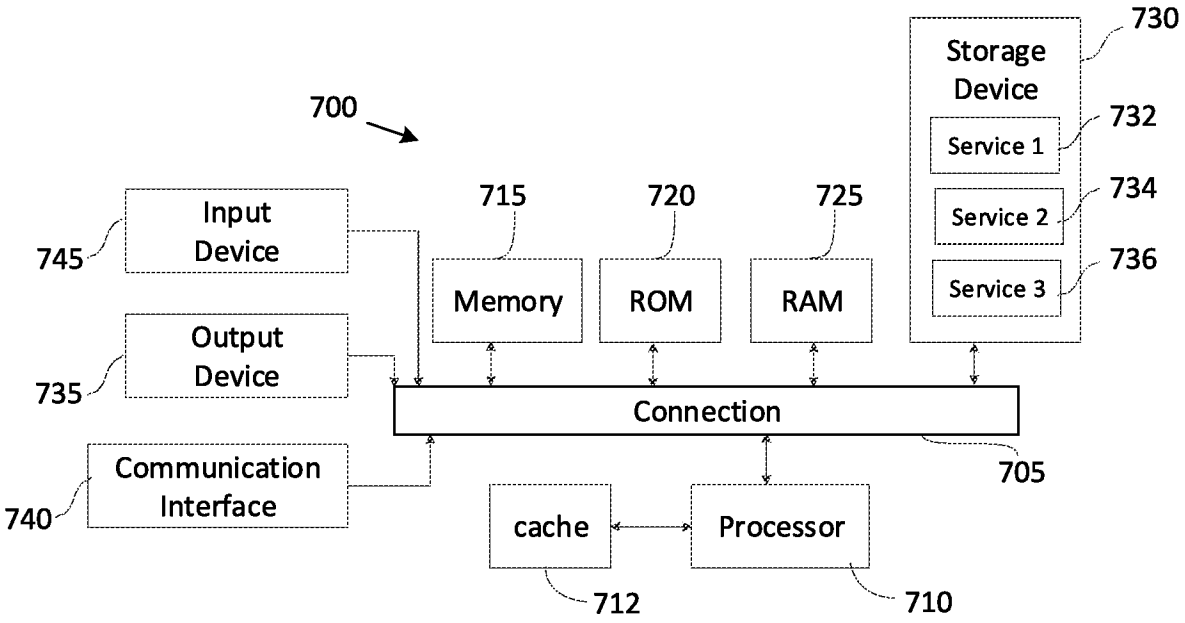
FIG. 7 is a schematic diagram of an example computing device architecture, in accordance with some examples.

As noted above, FIG. 7 illustrates the example computing device architecture 700 of a computing device which can implement the various technologies and techniques described herein. For example, the computing device architecture 700 can perform various steps, methods, and techniques disclosed herein. The components of the computing device architecture 700 are shown in electrical communication with each other using a connection 705, such as a bus. The example computing device architecture 700 includes a processing unit (CPU or processor) 710 and a computing device connection 705 that couples various computing device components including the computing device memory 715, such as read only memory (ROM) 720 and random access memory (RAM) 725, to the processor 710.

The computing device architecture 700 can include a cache of high-speed memory connected directly with, in close proximity to, or integrated as part of the processor 710. The computing device architecture 700 can copy data from the memory 715 and/or the storage device 730 to the cache 712 for quick access by the processor 710. In this way, the cache can provide a performance boost that avoids processor 710 delays while waiting for data. These and other modules can control or be configured to control the processor 710 to perform various actions. Other computing device memory 715 can be available for use as well. The memory 715 can include multiple different types of memory with different performance characteristics. The processor 710 can include any general purpose processor and a hardware or software service, such as service 1 732, service 2 734, and service 3 736 stored in storage device 730, configured to control the processor 710 as well as a special-purpose processor where software instructions are incorporated into the processor design. The processor 710 can be a self-contained system, containing multiple cores or processors, a bus, memory controller, cache, etc. A multi-core processor can be symmetric or asymmetric.

To enable user interaction with the computing device architecture 700, an input device 745 can represent any number of input mechanisms, such as a microphone for speech, a touch-sensitive screen for gesture or graphical input, keyboard, mouse, motion input, speech and so forth. An output device 735 can also be one or more of a number of output mechanisms known to those of skill in the art, such as a display, projector, television, speaker device, etc. In some instances, multimodal computing devices can enable a user to provide multiple types of input to communicate with the computing device architecture 700. The communications interface 740 can generally govern and manage the user input and computing device output. There is no restriction on operating on any particular hardware arrangement and therefore the basic features here can easily be substituted for improved hardware or firmware arrangements as they are developed.

Storage device 730 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 725, read only memory (ROM) 720, and hybrids thereof. The storage device 730 can include services 732, 734, 736 for controlling the processor 710. Other hardware or software modules are contemplated. The storage device 730 can be connected to the computing device connection 705. In one aspect, a hardware module that performs a particular function can include the software component stored in a computer-readable medium in connection with the necessary hardware components, such as the processor 710, connection 705, output device 735, and so forth, to carry out the function. In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

For clarity of explanation, in some instances the present technology can be presented as including individual functional blocks including functional blocks comprising devices, device components, steps or routines in a method embodied in software, or combinations of hardware and software.

Methods according to the above-described examples can be implemented using computer-executable instructions that are stored or otherwise available from computer readable media. Such instructions can include, for example, instructions and data which cause or otherwise configure a general purpose computer, special purpose computer, or a processing device to perform a certain function or group of functions. Portions of computer resources used can be accessible over a network. The computer executable instructions can be, for example, binaries, intermediate format instructions such as assembly language, firmware, source code, etc. Examples of computer-readable media that can be used to store instructions, information used, and/or information created during methods according to described examples include magnetic or optical disks, flash memory, USB devices provided with non-volatile memory, networked storage devices, and so on.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts can be otherwise variously embodied and employed, and that the appended claims are intended to be construed to include such variations, except as limited by the prior art. Various features and aspects of the above-described subject matter can be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods can be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

In the above description, terms such as "downhole," "uphole," "downlink," and "uplink," and the like, as used herein, shall mean in relation to the bottom or furthest extent of the surrounding wellbore even though the wellbore or portions of it may be deviated or horizontal. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder. The term "radially" means substantially in a direction along a radius of the object, or having a directional component in a direction along a radius of the object, even if the object is not exactly circular or cylindrical.

Although a variety of information was used to explain aspects within the scope of the appended claims, no limitation of the claims should be implied based on particular features or arrangements, as one of ordinary skill would be able to derive a wide variety of implementations. Further and although some subject matter can have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

What is claimed:

1. A method comprising:

deploying a wellbore dart configured for plugging at least one zone of a hydrocarbon well, the wellbore dart including a wellbore dart identifier;

deploying a shoulder in a casing of the at least one zone of the hydrocarbon well, the shoulder comprising a unique shoulder identifier;

receiving, by a node communication module of a reference node a communication from the wellbore dart for a period of time;

identifying speed and location information of the wellbore dart by comparing a maximum communication distance associated with the reference node with the period of time;

receiving, by a node communication module of a first node in the at least one zone, from the wellbore dart when the wellbore dart is proximate to the first node, the wellbore dart identifier, wherein the wellbore dart identifier is received from a dart communication module of the wellbore dart;

performing a comparison of the unique shoulder identifier and the wellbore dart identifier to determine that the unique shoulder identifier and the wellbore dart identifier match; detecting an arrival of the wellbore dart at an intended location for the wellbore dart based on the determination that the unique shoulder identifier and the wellbore dart identifier match, wherein the speed and location information also correspond to the intended location;

stopping the wellbore dart at the intended location based on the detecting of the arrival; and activating the wellbore dart to plug the at least one zone of the hydrocarbon well at the intended location.

2. The method of claim 1, wherein the activating of the wellbore dart includes sending, in response to detecting the arrival of the wellbore dart at the intended location, a command to a firing module of the wellbore dart, the command effective to cause the wellbore dart to plug the at least one zone of the hydrocarbon well.

3. The method of claim 1, wherein the dart communication module communicates with the first node as the wellbore dart traverses the hydrocarbon well.

4. The method of claim 1, wherein the first node is positioned adjacent to an interior surface of the hydrocarbon well.

5. The method of claim 1, further comprising receiving, by the first node, location information from the wellbore dart, wherein the location information further indicates a speed of the wellbore dart travelling through the hydrocarbon well.

6. The method of claim 1, wherein the first node is in communication with a surface operator through at least one of acoustic coupling, fiber optic cables, or electromagnetic waves.

7. The method of claim 1, wherein the first node is in communication with a second node to relay data from the second node to a surface operator.

8. A system comprising:

a wellbore dart comprising a dart communication module;

a first node comprising a node communication module and in communication with the wellbore dart via the node communication module; and a surface operator in communication with the first node, wherein the surface operator comprises one or more processors configured to perform operations for:

deploying the wellbore dart configured for plugging at least one zone of a hydrocarbon well, the wellbore dart including a wellbore dart identifier;

deploying a shoulder in a casing of the at least one zone of the hydrocarbon well, the shoulder comprising a unique shoulder identifier;

receiving, by a node communication module of a reference node a communication from the wellbore dart for a period of time;

identifying speed and location information of the wellbore dart by comparing a maximum communication distance associated with the reference node with the period of time;

receiving, by a node communication module of the first node in the at least one zone, from the wellbore dart when the wellbore dart is proximate to the first node, the wellbore dart identifier, wherein the wellbore dart identifier is received from a dart communication module of the wellbore dart;

performing a comparison of the unique shoulder identifier and the wellbore dart identifier to determine that the unique shoulder identifier and the wellbore dart identifier match; detecting an arrival of the wellbore dart at an intended location for the wellbore dart based on the determination that the unique shoulder identifier and the wellbore dart identifier match; stopping the wellbore dart at the intended location based on the detecting of the arrival; and activating the wellbore dart to plug the at least one zone of the hydrocarbon well at the intended location.

9. The system of claim 8, wherein the activating of the wellbore dart includes sending, in response to detecting the arrival of the wellbore dart at the intended location, a command to a firing module of the wellbore dart, the command effective to cause the wellbore dart to plug the at least one zone of the hydrocarbon well.

10. The system of claim 8, wherein the dart communication module communicates with the first node as the wellbore dart traverses the hydrocarbon well.

11. The system of claim 8, wherein the first node is positioned adjacent to an interior surface of the hydrocarbon well.

12. The system of claim 8, wherein the first node is configured to receive location information from the wellbore dart, and the location information further indicates a speed of the wellbore dart travelling through the hydrocarbon well.

13. The system of claim 8, wherein the first node is in communication with the surface operator through at least one of acoustic coupling, fiber optic cables, or electromagnetic waves.

14. The system of claim 8, wherein the first node is in communication with a second node to relay data from the second node to the surface operator.

15. A tangible, non-transitory, computer-readable media having instructions encoded thereon, the instructions, when executed by a processor, are operable to perform operations for:

deploying a wellbore dart configured for plugging at least one zone of a hydrocarbon well, the wellbore dart including a wellbore dart identifier;

deploying a shoulder in a casing of the at least one zone of the hydrocarbon well, the shoulder comprising a unique shoulder identifier;

receiving, by a node communication module of a reference node a communication from the wellbore dart for a period of time;

identifying speed and location information of the wellbore dart by comparing a maximum communication distance associated with the reference node with the period of time;

receiving, by a node communication module of a first node in the at least one zone, from the wellbore dart when the wellbore dart is proximate to the first node, the wellbore dart identifier, wherein the wellbore dart identifier is received from a dart communication module of the wellbore dart;

performing a comparison of the unique shoulder identifier and the wellbore dart identifier to determine that the unique shoulder identifier and the wellbore dart identifier match;

detecting an arrival of the wellbore dart at an intended location for the wellbore dart based on the determination that the unique shoulder identifier and the wellbore dart identifier match; stopping the wellbore dart at the intended location based on the detecting of the arrival; and activating the wellbore dart to plug the at least one zone of the hydrocarbon well at the intended location.

16. The tangible, non-transitory computer-readable media of claim 15, wherein the activating of the wellbore dart includes sending, in response to detecting the arrival of the wellbore dart at the intended location, a command to a firing module of the wellbore dart, the command effective to cause the wellbore dart to plug the at least one zone of the hydrocarbon well.

17. The tangible, non-transitory computer-readable media of claim 15, wherein the dart communication module communicates with the first node as the wellbore dart traverses through the hydrocarbon well.

18. The tangible, non-transitory computer-readable media of claim 15, wherein the first node is positioned adjacent to an interior surface of the hydrocarbon well.

19. The tangible, non-transitory computer-readable media of claim 15, wherein the instructions, when executed by the processor, are operable to perform further operations for receiving, by the first node, location information from the wellbore dart, and the location information further indicates a speed of the wellbore dart travelling through the hydrocarbon well.

20. The tangible, non-transitory computer-readable media of claim 15, wherein the first node is in communication with a surface operator through at least one of acoustic coupling, fiber optic cables, or electromagnetic waves.

* * * * *